US006968895B2

(12) United States Patent
Mosing et al.

(10) Patent No.: US 6,968,895 B2
(45) Date of Patent: Nov. 29, 2005

(54) DRILLING RIG ELEVATOR SAFETY SYSTEM

(75) Inventors: Donald E. Mosing, Lafayette, LA (US); Jon A. Veverica, Katy, TX (US); Jeremy R. Angelle, Lafayette, LA (US); Robbie L. Thibodeaux, Jr., Lafayette, LA (US)

(73) Assignee: Frank's Casing Crew and Rental Tools, Lafayette, LA (US)

( * ) Notice: Subject to any disclaimer, the term of this patent is extended or adjusted under 35 U.S.C. 154(b) by 239 days.

(21) Appl. No.: 10/658,519

(22) Filed: Sep. 9, 2003

(65) Prior Publication Data

US 2005/0051324 A1 Mar. 10, 2005

(51) Int. Cl.[7] ..... E21B 19/07

(52) U.S. Cl. ..... 166/77.52; 166/66

(58) Field of Search ..... 175/40, 203; 166/66, 166/77.52, 65.1; 73/152.43; 294/102.2

(56) References Cited

U.S. PATENT DOCUMENTS

| | | | | |
|---|---|---|---|---|
| 4,511,168 | A * | 4/1985 | Haynes | 294/102.2 |
| 4,579,379 | A * | 4/1986 | Berg | 294/102.2 |
| 4,878,705 | A | 11/1989 | Arnquist | |
| 5,791,410 | A | 8/1998 | Castille et al. | |
| 5,909,768 | A | 6/1999 | Castille et al. | |
| 6,386,282 | B1 | 5/2002 | Jansch | |
| 6,742,596 | B2 * | 6/2004 | Haugen | 166/380 |

* cited by examiner

*Primary Examiner*—David Bagnell
*Assistant Examiner*—K. Thompson
(74) *Attorney, Agent, or Firm*—The Matthews Firm

(57) ABSTRACT

The apparatus is connected to a member on the elevator that moves if and when the slips move between the open and closed positions. The member is locked in a preselected position that attends the position of the slips when the elevator is considered safe. When the member is in that safe position a wireless signal is generated by the apparatus part on the elevator and received by a receiving part of the apparatus in a convenient remote location such as the drillers position. In response to the received signal, the receiving part produces a visible signal to indicate that the slips are in the preselected position.

14 Claims, 1 Drawing Sheet

SLIPS IN "SET" POSITION

SLIPS IN OPEN POSITION

SLIPS IN OPEN POSITION

SLIPS IN "SET" POSITION

DRILLING RIG ELEVATOR SAFETY SYSTEM

This invention pertains to apparatus to indicate the status of safety features on an oil field elevator. More particularly, it pertains to apparatus to indicate at the derrick floor a condition which prevents opening of elevator slips when the pipe string load is not present on the elevator slips.

BACKGROUND OF INVENTION

Most oil field elevators are lifted by bails from a traveling block and lift pipe that passes vertically trough an opening extending along the elevator general centerline. Such elevators usually have doors, open like a book, or have a closed peripheral body containing a slip bowl in which slips operate to grip pipe. Slips are effectively wedges and the force of gripped pipe pulls the slips downward in the funnel shaped slip bowl to assure inward wedging of the slips to securely grip pipe. This invention relates to slip equipped elevators.

Oil field elevators that have to lift slips to release pipe strings suspended by the elevator are usually not capable of releasing pipe strings that are pulling down on the slips. To lift the slips and release the pipe considerable upward force is required to first lift the pipe string and then lift the slips.

The apparently reliable fail-safe system can sometimes fail under certain circumstances. Pipe strings have been dropped into wells because the pipe string, moving downward in the well, encountered brief resistance to movement and the elevator moved downward relative to the pipe. Moving upward relative to the elevator, the pipe weight no longer urged the slips closed. That allowed the slips to move upward and create a condition to drop the pipe. To avoid such accidents, a safety latch was provided to lock the slip control in the slips-down position. From the drilling floor, however, it is not easy to determine if the safety latch is in the safe position and some accidental drops continued to occur.

There is a need to provide a driller level indicator that the slip safety latch is in the safe position. There is a further need to avoid adding to the wires that already descend from various derrick apparatus to the drilling floor. In addition, the safety feature should be workable without time consuming drilling rig modifications. The needs represent objectives in pursuing the development of the present invention.

SUMMARY OF INVENTION

The elevator to be fitted with the present invention will have an element that moves in sympathy with the slip relative to the elevator body. That element is fitted with an elevator mounted lock system that immobilizes the element and prevents accidental opening of the slips. A switch that cooperates with the element senses the locked safe position of the slips and provides a signal. The signal activates an elevator mounted transmitter that emits a wireless signal that travels to a receiver on the rig floor, or drillers location. The receiver, in turn, produces an output signal that can be detected by the driller. The driller may be human or contrivance capable of reacting to the signal to carry out appropriate activities. The nature of the signal is selected in light of the nature of the driller expected to respond to the signal.

These and other objects, advantages, and features of this invention will be apparent to those skilled in the art from a consideration of this specification, including the attached claims and appended drawings.

DETAILED DESCRIPTION OF DRAWINGS

Figure 1:
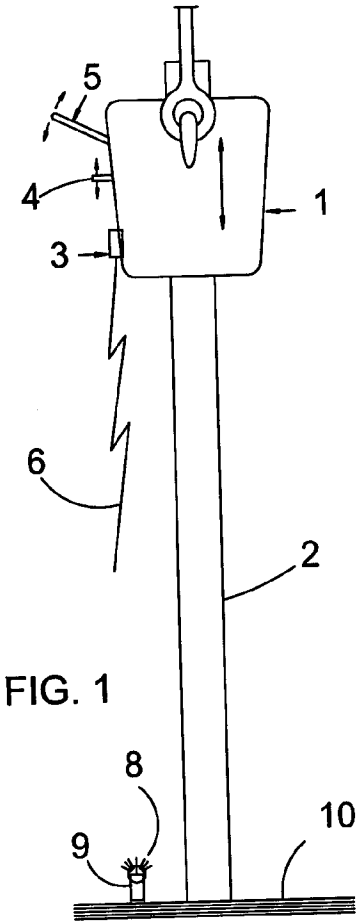
FIG. 1 is a side view, generally symbolic, of an elevator lifting a pipe string and fitted with the safety apparatus of this intention.

FIG. 1 is a symbolic representation of the common drilling activity in which elevator 1 is used to suspend pipe string 2 in a well extending below rig floor 10. No traveling block is shown suspending elevator 1 in the derrick, also not shown. Lever 5 or the equivalent is used to lift and lower the slips in elevator 1. Safety lever 4 is moved, as indicated by arrows, to enable the movement of lever 5. Unless lever 4 is in a selected position, lever 5 can lift the elevator slips and drop a pipe string. Further, the slips can be lifted by an upward force that results from brief release of the pipe string load. By processes described later herein, a selected position of lever 4 locks the slip lifting system and causes a signal to be sent to transmitter 3. Transmitter 3, by electromagnetic or sonic emissions 6, causes the receiver 9 to produce a signal 8 detectable by a driller as an indication that lever 4 is in the selected position. The driller may be human or machine and the signal is made detectable in light of the nature of the driller.

By design choice, the indicator 8 is used to indicate a safe (slips closed and locked) condition so that a system failure, producing no signal, will not indicate a safe condition. Further, by choice, emission 6 is a radio frequency emission.

Figure 3:
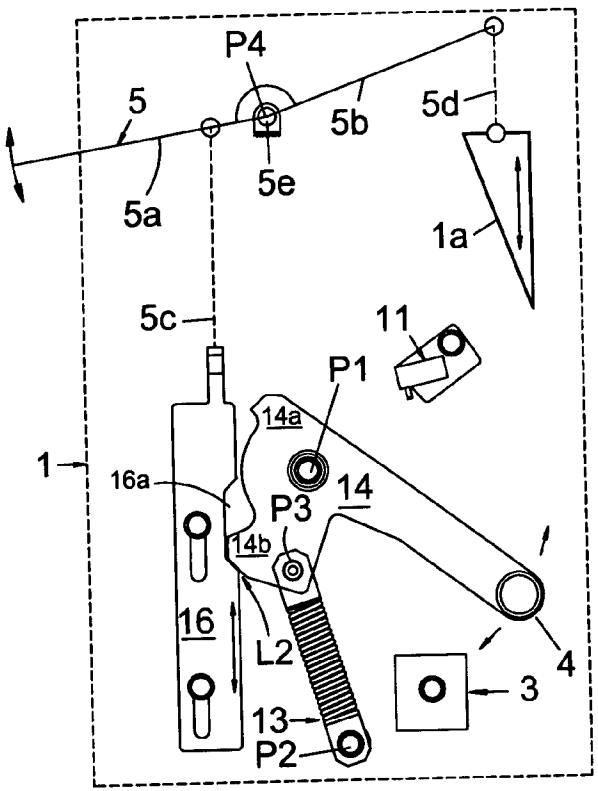
FIG. 3 is similar to FIG. 2 but showing the elevator slips in the open situation.
Figure 2:
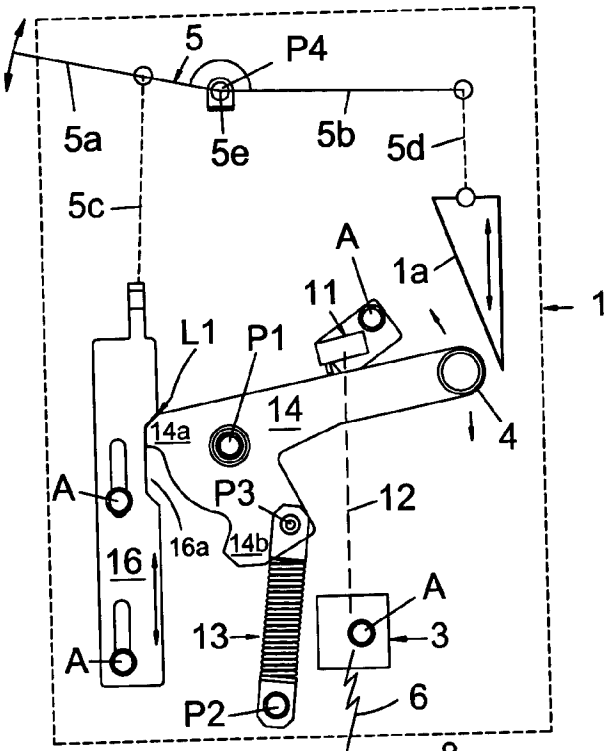
FIG. 2 is a side view, generally symbolic, of an elevator with the cooperating functional features related to the invention, when the elevator slips are set for lifting.

FIGS. 2 and 3 symbolically show the general linkage equivalent to that in most elevators using slips and having a slip operating lever. Above link 5*c,* all movements and pivot axes are symbolic and the position of elements such as slips 1*a* do not suggest graphic relationships to other elements. The dotted box represents the elevator general embodiment. Slip operating lever 5 has components or extensions 5*a,* 5*b,* and 5*d.* Principal components and functions shown are common or usable on most slip equipped elevators. For elevators using levers to actuate the slips, linkage 5*c,* or an equivalent, enables the use of the safety latch and the position indicator illustrated. Some elevators have no link 5*d* and lift slips by way of notches that engage lever extension 5*b.* Enabling link 16 is slidably attached to the elevator frame. Rocker 14 is pivotably attache to the elevator by stud P1. Over-center toggle bias link 13 is pivotably attached to the elevator by stud P2. P3 is the toggle pivot point on rocker 14. Handle 4 is the manually movable part of rocker 14. The notation A refers to attachment means to secure parts to the elevator body. Lever 5 consists of parts that pivot about elevator body attachment stud P4. Link 5*d* is often replaced by a slot in the slips that capture lever part 5*b.*

The slip closed position is shown by FIG. 2. By choice, the switch 11 is actuated by rocker 14 in this position and it closes a circuit 12 to actuate transmitter 3. The elevator is movable relative to the receiver 9 which is usually near the driller on the rig floor. Transmitter 3 sends a signal 6, preferably radio frequency electromagnetic, to receiver 9 which emits an indication 8, preferably a light, in response. By observing light 8, the driller knows the elevator slips are closed. In light intensive situations, semaphore-type elements or the equivalent may serve as indicators.

To open the slips 1*a,* rocker 14 is rotated clockwise by moving handle 4 downward. Locking lug 14*a* moves out of engagement notch 16*a* allowing enabling link 16 to move downward, in sympathy with lifting of slips 1*a,* when the pipe string load on the slips is lifted. Engagement notch 16*a* is too short for locking lug 14*b* to move immediately into the most clockwise position. The toggle bias 13 continues to urge the lug 14*b* against link 16 until link 16 is in the downward position that exists when the slips are lifted to the open position. Then, lug 14*b* moves to lock link 16 downward, and that locks the slips in the open position. A switch such a 11 can be situated to respond to the locked-open slip position and set in motion a preselected indicator that is not easily confused with the slips closed and locked indication.

When the slips are to be closed, or set, handle 4 is moved upward. Lug 14*b* comes out of notch 16*a* and link 16 is free to move upward, allowing the slips to move into the closed position, usually urged in that direction by movement of lever 5. Until the slips are fully downward to the set position, toggle bias 13 applies a counter-clockwise force on rocker 14 but lug 14*a* cannot enter the short notch 16*a* until link 16 is in a fully upward position which attends the slips set position. A danger period exists after handle 4 is moved upward to lock the slips, and after lever 5 is moved to set the slips, but before the slips do set allowing lug 14*a* to enter notch 16*a*. Switch 11 is set such that it will not actuate until lug 14*a* enters notch 16*a,* which allows rocker 14 to move the final amount. Locking action is indicated by L1. When lug 14*b* enters notch 16*a* the lock situation L2 exists. That position prohibits closing of the slips and an indicator is not usually required.

A second danger period exists if rocker 14 is rotated enough for lug 14*b* to allow link 16 to move upward but the rocker is not moved enough for toggle bias 13 to go over center and urge lug 14*a* into notch 16*a*. In that situation, the slips may be safely supporting the pipe string but if the pipe string load is relieved briefly by such as ledging the downwardly moving pipe string, the slips can suddenly be urged upward by drag on the suddenly stopped drill string. Upward movement of the slips can drop the pipe string into the well. That can destroy a drill string and jeopardize the related well. Switch 11 will not be actuated in this period.

Transmitter 3, by choice is a battery operated contrivance, eliminating the need for power conductors extending to the elevator to serve the transmitter. The transmitter and receiver are available off the shelf and need only ruggedized cases for the intended purpose.

The configuration shown by the drawings represents an apparatus arranged to fit and serve an existing elevator on hand. The rotation and sliding elements of the apparatus have generic equivalents of several forms. Such alternate forms are well known to those skilled in the art. The choices of elements indicated resulted from conveniences in construction related to machines on hand and are not to be construed in a limiting sense.

From the foregoing, it will be seen that this invention is one well adapted to attain all of the ends and objects hereinabove set forth, together with other advantages which are obvious and which are inherent to the apparatus.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

What is claimed is:

1. An elevator safety indicator apparatus for use on slip equipped oil field drilling rig elevators to indicate to the driller when the slips are closed and locked in the closed position, the apparatus comprising:

a) a lock enabling means, situated on the elevator, and arranged to move in sympathy with the slips;

b) lock means situated to immobilize the lock enabling means when the slips are in at least one preselected position;

c) a wireless signal transmitter on the elevator, responsive to the lock means, to transmit a signal when the slips are locked in the preselected position; and d) a receiver located on the drilling rig, remote from the elevator, arranged to receive the signal and produce a visible indication that the signal has been received.

2. The apparatus of claim 1 wherein said lock means is movable toward the position to immobilize the lock enabling means, and is biased to complete the movement, but denied the completion of the movement until the slips are in the lockable position.

3. The apparatus of claim 1 wherein said preselected position includes that position that exists when the slips are open and that position which exists when the slips are closed.

4. The apparatus of claim 1 wherein said wireless signal is a radio frequency transmission.

5. The apparatus of claim 1 wherein said wireless signal is acoustic.

6. The apparatus of claim 1 wherein said wireless signal is in the infra-red range of the electromagnetic spectrum.

7. An elevator safety indicator apparatus for use on slip equipped elevators to indicate to the driller when the slips are closed and locked in the closed position, the apparatus comprising:

a) a slip equipped elevator with linkage that moves in sympathy with movement of the slips between a slips open position and a slips closed position;

b) a lock enabling means, situated on the elevator, and attached to said linkage for sympathetic movement therewith, and arranged such that locking the enabling means locks the slips in at least one preselected position;

c) lock means situated to immobilize the lock enabling means when the slips are in at least one preselected position;

d) a wireless signal transmitter on the elevator, responsive to the lock means, to transmit a wireless signal when the slips are locked in the preselected position; and e) a receiver located on the drilling rig, remote from the elevator, arranged to receive the signal and produce a visible indication that the signal has been received.

8. The apparatus of claim 7 wherein said visible indication is a condition processable by automatic driller controls.

9. The apparatus of claim 7 wherein said wireless signal is a radio frequency electromagnetic transmission.

10. The apparatus of claim 7 wherein said wireless signal is an electromagnetic transmission in the infra-red range of the spectrum.

11. The apparatus of claim 7 wherein said wireless signal is sonic.

12. The apparatus of claim 11 wherein said wireless signal is a sound transmission with a frequency greater than 21,000 Hertz.

13. The apparatus of claim 7 wherein said lock means, once moved toward the lock position, remains biased toward the lock position until the lock enabling means is in the lockable position, the signal being withheld until the lock enabling means is locked in the slip closed position.

14. The apparatus of claim 7 wherein said wireless signal transmitter is battery operated with the battery carried by the elevator.

* * * * *